US006401272B2

(12) United States Patent
Shimizu et al.

(10) Patent No.: US 6,401,272 B2
(45) **Date of Patent: *Jun. 11, 2002**

(54) HAIR WASHER

(75) Inventors: Hirohisa Shimizu; Hideaki Miyoshi, both of Osaka (JP)

(73) Assignee: Oohiro Works, Ltd., Osaka (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/476,063

(22) Filed: Dec. 30, 1999

(30) Foreign Application Priority Data

Jun. 11, 1999 (JP) ..... 11-165266

(51) Int. Cl.[7] ..... A45D 19/00
(52) U.S. Cl. ..... 4/518; 239/587.4
(58) Field of Search ..... 4/515, 516, 517, 4/518, 519, 541.6, 537, 601, 492; 239/587.4

(56) References Cited

U.S. PATENT DOCUMENTS 982,661 A * 1/1911 Dickens ..... 239/587.4
1,222,726 A * 4/1917 Brickell ..... 239/587.4
1,354,838 A * 10/1920 Perkins ..... 4/601 X
1,758,115 A * 5/1930 Kelly ..... 4/601 X
2,647,796 A * 8/1953 Ziherl ..... 239/587.4
2,971,701 A * 2/1961 Shames et al. ..... 239/587.4
3,411,499 A * 11/1968 Jacuzzi ..... 4/492 X
3,421,702 A * 1/1969 O'Brien ..... 239/587.4
3,985,303 A * 10/1976 Steimle ..... 4/541.6 X
4,426,040 A * 1/1984 Smith ..... 239/590.3 X
5,143,298 A * 9/1992 Prokopoff ..... 239/587.4

* cited by examiner

*Primary Examiner*—Robert M. Fetsuga
(74) *Attorney, Agent, or Firm*—Burr & Brown

(57) ABSTRACT

The present invention provides a hair washer which changes spouting angles of the respective washing nozzles in accordance with a figure, a hair style, and dirt levels of hair of a person under hair washing, thereby washing securely parts where a washing needs to be performed. An engage part 3*a* of a nozzle holding means 3 is engaged with an end part of a coupler 2 with respective approximately spherical-shaped base parts 1*b* and 4*b* of a mist nozzle 1 or a shower nozzle 4 being placed on a hemispherical-shaped nozzle receiving part 2*a*, whereby the respective base parts 1*b* and 4*b* of the mist nozzle 1 and the shower nozzle 4 touch an O-ring 3*c* disposed in a nozzle holding means 3. Therefore, the respective base parts 1*b* and 4*b* enables to move slidably along a face of a nozzle receiving part 2*a* of the coupler 2, to change directions of the respective spouting orifices 1*a* and 4*a* of the mist nozzle 1 and the shower nozzle 4.

2 Claims, 4 Drawing Sheets

Fig.2 - Prior Art
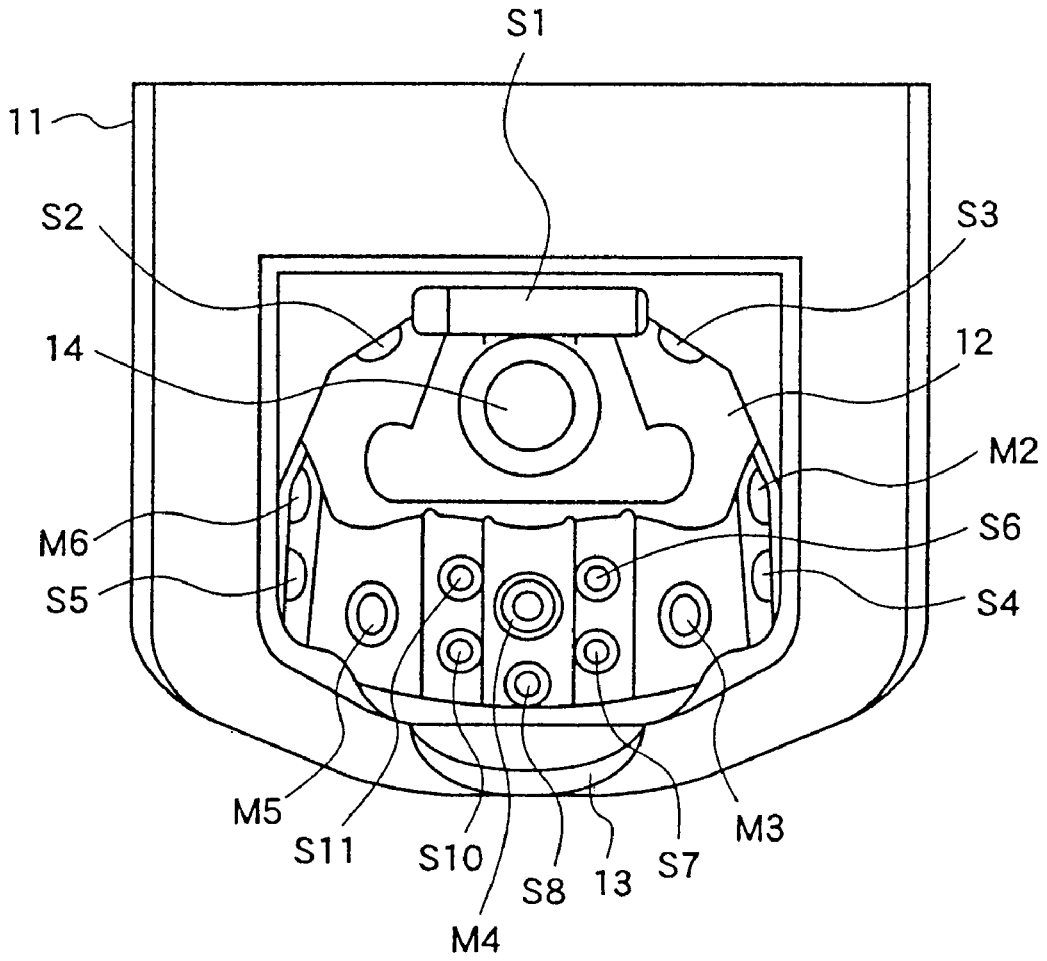

Fig.3 - Prior Art
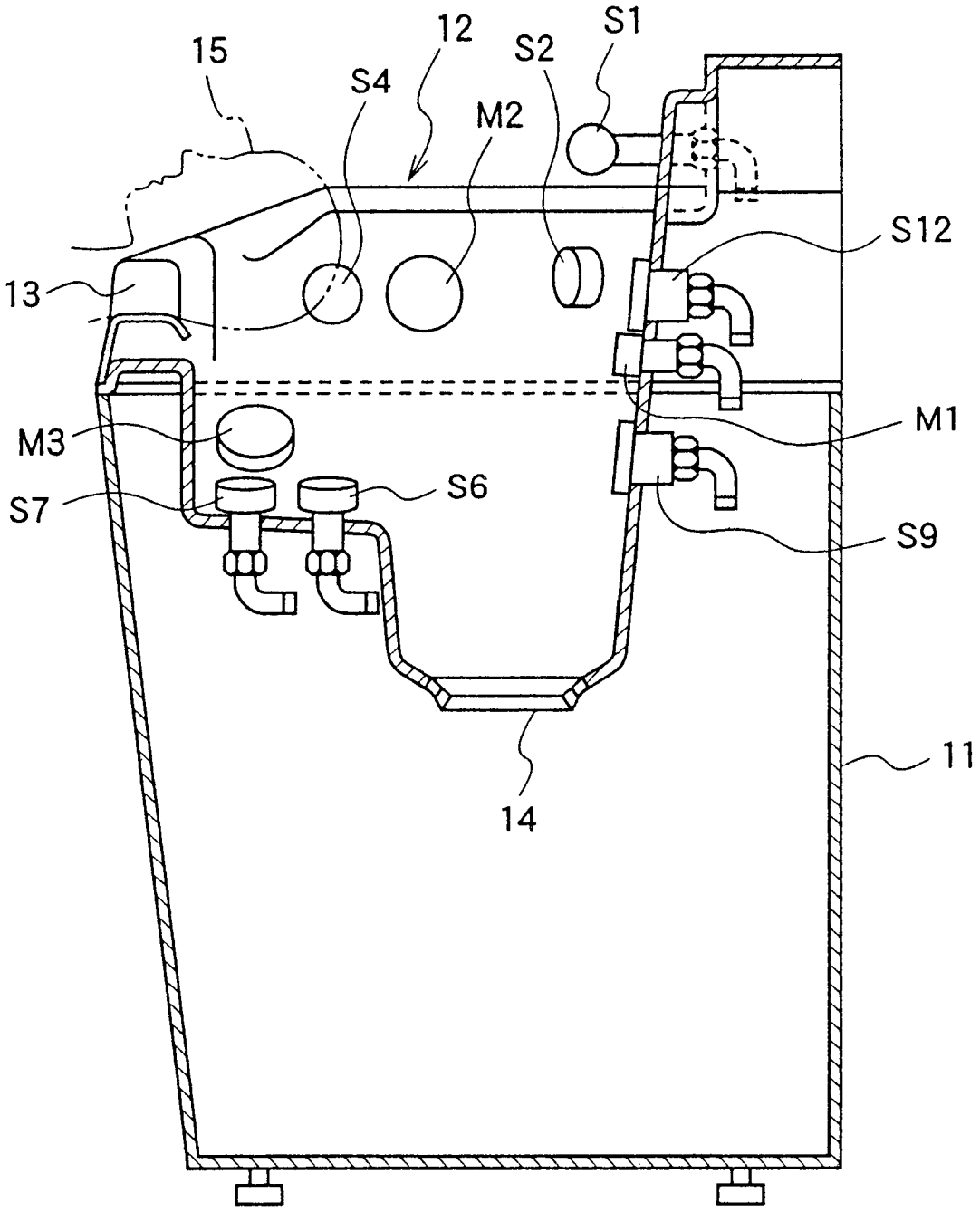

Fig.4 (a) - Prior Art
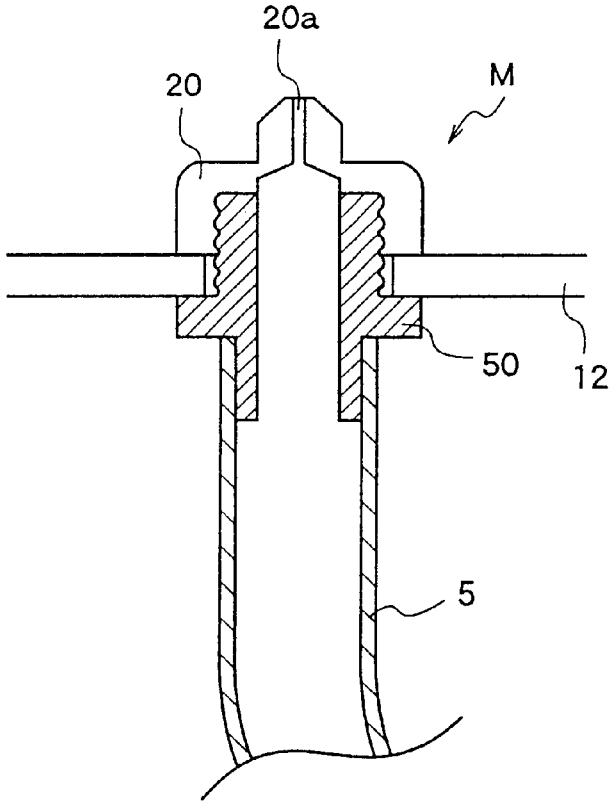
Fig.4 (b) - Prior Art
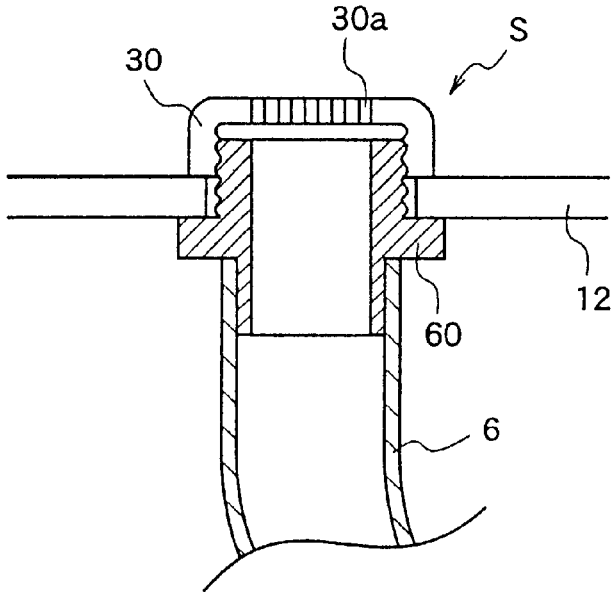

HAIR WASHER

FIELD OF THE INVENTION

The present invention relates to a hair washer which is established in a beauty salon, a barber's shop or the like, and more particularly to washing nozzles.

BACKGROUND OF THE INVENTION

FIGS. 2 and 3 are diagrams schematically illustrating the construction of a prior art hair washer. FIG. 2 is a plan view and FIG. 3 is a longitudinal sectional view.

In the figures, reference numeral 11 designates a cabinet. Numeral 12 designates a cistern provided within the cabinet 11, into which a person under hair washing 15 inserts his head. Numeral 13 designates a neck receiving part for supporting the nape part of the person under hair washing 15 when the person inserts his head into the cistern 12. Numeral 14 designates a draining port provided on the bottom of the cistern 12. Characters M1 to M6 designate mist heads for spouting hot water mixed with shampoo agent or conditioner agent. Characters S1 to S12 designate shower heads for spouting hot water.

As shown in the figures, the shower heads S1 to S12 and the mist heads M1 to M6 are provided on inner walls of the cistern 12. Hair washing is performed using hot water spouted from the shower heads S1 to S12 and hot water mixed with the shampoo agent or the conditioner agent spouted from the mist heads M1 to M6. A series of hair washing processes are completed by the following processes: preliminary washing, a shampooing process, a rinsing process, a conditioning process, and a rinsing process. The shower heads S1 to S12 and the mist heads M1 to M6 automatically spout hot water or the like during a predetermined period in accordance with the respective processes of hair washing via control from a control device (not shown).

In addition, the spouting directions of the shower heads S and the respective mist heads M are set such that the shower heads S1 and S12, and the mist head M1 spout hot water or the like to the top of the head, shower heads S2 to S5 and mist heads M2 and M6 spout the same to the sides of the head, and shower heads S7 to S10 spout the same to the nape part, whereby washing is performed.

FIGS. 4 illustrate the construction of the washing nozzles of a prior art washing apparatus. FIG. 4(*a*) is a longitudinal cross sectional view illustrating the construction of a mist head M. FIG. 4(*b*) is a longitudinal cross sectional view illustrating the construction of a shower head S.

In FIG. 4, the same reference numerals and characters as those in FIGS. 2 and 3 designate the same or corresponding parts.

As shown in FIG. 4(*a*), in a mist head M, a mist nozzle 20 is connected to a washing water supply pipe 5 by a coupler 50.

The washing water supply pipe 5 leads hot water which is pumped out from a hot water storing tank (not shown) within the cabinet 11 and hot water mixed with shampoo agent or conditioner agent obtained by mixing hot water with shampoo agent or conditioner agent which is pumped out from a shampoo tank or a conditioner tank (not shown), to supply the same to the mist nozzle 20.

The coupler 50 is provided so as to pass through a wall part of the cistern 12, one end of which is connected to the washing water supply pipe 5, while the other end of which is connected to the mist nozzle 20.

The mist nozzle 20 is provided with a single spouting orifice 20*a* on an upper part thereof, thereby spouting like a mist the hot water mixed with the shampoo agent or the conditioner agent which is supplied from the washing water supply pipe 5 via the coupler 50.

As shown in FIG. 4(*b*), in the shower head S, the shower nozzle 30 is connected to the hot water supply pipe 6 by a coupler 60.

The hot water supply pipe 6 leads hot water which is pumped out from the hot water storing tank within the cabinet 11, to supply the same to the shower nozzle 30.

The coupler 60 is provided so as to pass through a wall part of the cistern 12, one end of which is connected to the hot water supply pipe 6, while the other end of which is connected to the shower nozzle 30.

The shower nozzle 30 is provided with a plurality of spouting orifices on an upper part thereof, thereby spouting like a shower the hot water which is supplied from the hot water supply pipe 6 via the coupler 60.

Hereinafter, an explanation will be given of a method for performing hair washing to a person whose hair is to be washed using a hair washer constituted as described above.

The operation of hair washing is started when a person whose hair is to be washed lies on his back while putting his nape on the neck receiving part 13, and inserting his head into the cistern 12.

First, hot water is spouted from the shower heads S1 to S12, to perform hair washing during a predetermined period.

Next, a shampooing process follows, and hot water is spouted from the shower heads S1 to S12 as well as hot water mixed with shampoo agent is spouted from the mist heads M1 to M6, to perform hair washing with shampoo.

Next, a rinsing process follows, and spouting of the hot water mixed with shampoo agent from the mist heads M1 to M6 is stopped, to perform hair washing using hot water spouted from the shower heads S1 to S12.

Next, a conditioning process follows, hot water is spouted from the shower heads S1 to S12 as well as hot water mixed with conditioner agent is spouted from the mist heads M1 to M6, to perform hair washing with rinse.

Next, a rinsing process follows, and spouting of the hot water mixed with conditioner agent from the mist heads M1 to M6 is stopped, to perform hair washing using hot water spouted from the shower heads S1 to S12. Then a series of washing process ends.

However, in the prior art hair washer, washing nozzles are fixed disposed. Therefore the spouting range of hot water or the like from the washing nozzles is kept constant and the spouting range is concentrated in the center of the cistern.

Therefore, when the hair style of a person under hair washing is short, it is possible to wash all of his hair within the spouting range of the washing nozzles, whereas when the hair style of a person under hair washing is long, there arises problem that hot water or the like from the washing nozzles does not spread over some parts if the hair which are out of the spouting range of the washing nozzles, for example, tip parts of his hair, or the like, whereby there arise a problem such that hair washing is complete.

In addition, even when only one part of the head needs to be washed concentratedly, in the case where a permanent wave or hair coloring is performed, or hair is partly dirty, or the like, the spouting range from the washing nozzles is kept constant. Accordingly, hot water or the like is spouted to some parts where washing is not required to be performed, thereby being uneconomical and inefficient.

SUMMARY OF THE INVENTION

To solve the above problems, it is an object of the present invention to provide a hair washer which enables partial hair washing, and which can wash hair in a condition most suitable for hair style and figure of the person undergoing hair washing.

Other objects and advantages of the present invention will become apparent from the detailed description, and the specific embodiments described are provided only for illustration since various additions and modifications within the spirit and scope of the invention will be apparent to those of skill in the art from the detailed description.

According to a first aspect of the present invention, a hair washer having a cistern, to which a person under hair washing enables to insert his head and a liquid spouting means for spouting liquid supplied from a supply pipe, which is provided on an inner wall of the cistern, wherein the liquid spouting means comprises a nozzle for spouting liquid, a coupler for connecting the nozzle to the supply pipe, and a nozzle holding means for fixing the nozzle and the coupler on inner walls of the cistern, the nozzle has an approximately spherical-shaped base part, the coupler has a nozzle receiving part having a hemispherical-shaped recessed part for engaging with the approximately spherical-shaped base part of the nozzle, and the nozzle holding means comprises an engage part for engaging with an end part, on which the nozzle receiving part of the coupler is formed and a touching part for touching the base part of the nozzle placed on the nozzle receiving part of the coupler, thereby holding slidably the base part of the nozzle along a face of the nozzle receiving part.

Therefore, it is possible to turn the respective directions of the spouting orifice of the nozzles to parts where washing needs to be performed in accordance with the figure hair style, and dirt levels of the hair of a person under hair washing, whereby an efficient and economical hair washing can be performed.

BRIEF DESCRIPTION OF THE DRAWINGS

FIG. 1(*a*) is a longitudinal sectional view illustrating the construction of a mist head M.

FIG. 1(*b*) is a longitudinal sectional view illustrating the construction of a shower head S.

FIG. 2 is a plan view schematically illustrating the construction of a hair washer of the first embodiment.

FIG. 3 is a longitudinal sectional view schematically illustrating the construction of a hair washer of the first embodiment.

FIGS. 4(*a*) and 4(*b*) are diagrams illustrating washing nozzles in a prior art hair washer.

FIG. 4(*a*) is a longitudinal sectional view illustrating the construction of a mist head M.

FIG. 4(*b*) is a longitudinal sectional view illustrating the construction of a shower head S.

DETAILED DESCRIPTION OF THE PREFERRED EMBODIMENTS

Embodiment 1.

Figure 1:
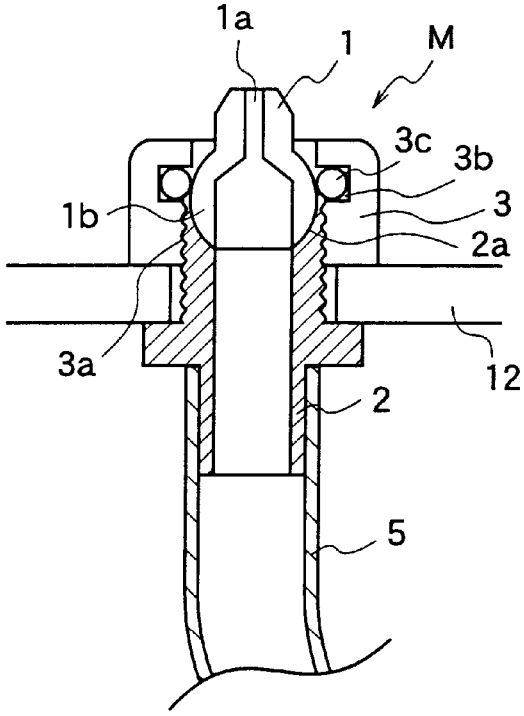
FIGS. 1(*a*) and 1(*b*) are diagrams illustrating the construction of the washing nozzles of a hair washer according to a first embodiment of the present invention.
Figure 1:
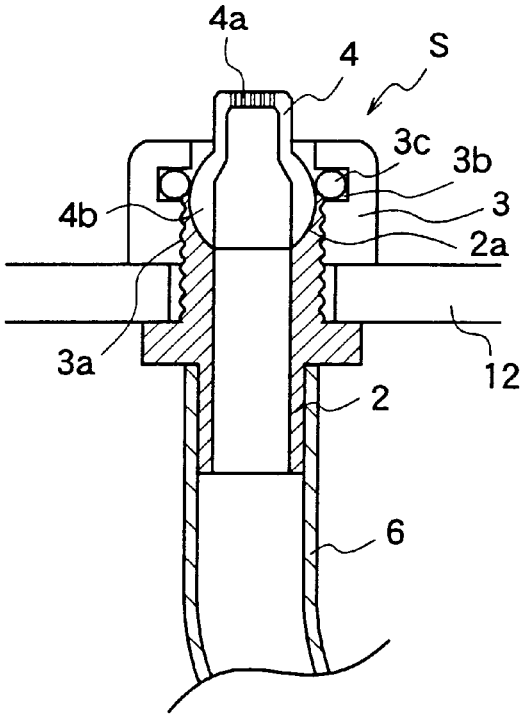

FIGS. 1(*a*) and 1(*b*) are diagrams illustrating the construction of the washing nozzles of a hair washer according to a first embodiment of the present invention. FIG. 1(*a*) is a longitudinal sectional view illustrating the construction of a mist head M. FIG. 1(*b*) is a longitudinal sectional view illustrating the construction of a shower head S.

In FIGS. 1(*a*) and 1(*b*), the same reference numerals and characters as those in FIGS. 2 to 4 designate the same or corresponding parts. In addition, a mist nozzle 1 and a shower nozzle 4 respectively have approximately spherical-shaped base parts 1*b* and 4*b* at a lower part thereof. The mist nozzle 1 and the shower nozzle 4 respectively have inlet orifices adjacent surfaces of the spherical base parts 1*b* and 4*b*, the inlet orifices communicating with the spouting orifice 1*a* and orifices 4*a*. Numeral 2 designates a coupler, one end of which is connected to a washing nozzle 5 or a hot water supply pipe 6, and on the other end of which a nozzle receiving part 2*a* having a recessed part is formed. The coupler has a laterally extending cistern engaging portion which abuts against a cistern 12. Numeral 3 designates a nozzle holding means for fixing a mist nozzle 1 and a shower nozzle 4 along the surface of a wall of the cistern 12. Numeral 3*a* is an engaging part formed on an inner circumference of the nozzle holding means 3, which is engaged with an end part forming the nozzle receiving part 2*a* of the coupler 2, to fix the coupler 2 on the cistern 12. Numeral 3*b* is an O-ring groove, which is formed at the upper part of the engaging part 3*a* on an inner circumference of the nozzle holding means 3. Numeral 3*c* designates an O-ring provided in the O-ring groove 3*b*.

In FIGS. 1(*a*) and 1(*b*), the engaging part 3*a* of the nozzle holding means 3 is engaged with the end part of the coupler 2 forming the nozzle receiver 2*a* being respectively engaged with the base parts 1*b* and 4*b* of the mist nozzle 1 and the shower nozzle 4 being placed on the receiving part 2*a* of the coupler 2, thereby holding the mist nozzle 1 and the shower nozzle 4 along inner walls of the cistern 12. Here, the base parts 1*b* and 4*b* of the mist nozzle 1 and the shower nozzle 4 touch the O-ring 3*c* provided in the nozzle holding means 3, and the respective base parts 1*b* and 4*b* of the mist nozzle 1 and the shower nozzle 4 are held slidably along a surface of the nozzle receiving part 2*a* with the nozzle receiving part 2*a* of the coupler 2 and the O-ring 3*c* provided in the nozzle holding means 3.

Accordingly, in the hair washer according to the first embodiment, the respective base parts 1*b* and 4*b* of the mist nozzle 1 and the shower nozzle 4 move slidably along the nozzle receiving part 2*a*, thereby enabling changing of the direction of the respective spouting orifices 1*a* and 4*a* of the mist nozzle 1 and the shower nozzle 4.

Hereinafter, an explanation will be given of a method for performing a hair washing of a person whose hair is to be washed using the hair washer according to the first embodiment constituted as described above.

At first, a person under hair washing 15 lies on his back with his head inserted into the cistern, and the respective spouting orifices 1*a* of the mist nozzles 1 of the mist heads M1 to M6 are turned manually to parts where washing needs to be performed in accordance with the hair style and/or dirt levels of the person under hair washing, to adjust spout angle of the respective mist nozzles 1. In more detail, when turning the direction of the spouting orifices, the hemispherical-shaped base parts of the mist nozzle 1 move slidably by the O-ring 3*c* disposed in the O-ring groove 3*b* of the nozzle holding means 3 along a surface of the nozzle receiving part 2*a* of the coupler 2, thereby changing the direction of the respective spouting orifices of the mist nozzles 1.

In the same manner as described above, the respective spouting orifices 4*a* of the shower nozzles 4 of the shower heads S1 to S12 are turned manually to the parts where washing needs to be performed, to adjust the spout angle of the respective shower nozzles 4.

Next, when the washing operation is started, hot water, hot water mixed with shampoo agent or conditioner agent is respectively spouted from the shower nozzle 4 of the shower heads S1 to S12, and the mist nozzles 1 of the mist heads M1 to M6, whose respective spout directions are set, to perform preliminary washing, washing with shampoo agent, rinsing, washing with conditioner agent, and rinsing, and then the series of washing processes ends.

In the above-described washing process, the respective spout directions of the mist nozzles 1 of the mist heads M1 to M6 and the shower nozzles 4 of the shower heads S1 to S12 are set, thereby enabling concentrated washing of parts where washing needs to be performed.

As described above, according to a hair washer of the first embodiment, the respective base parts 1*b* and 4*b* of the mist nozzle 1 of the mist head M or the shower nozzle 4 of the shower head S move slidably along a face of the nozzle receiving part 2*a* of the coupler 2 by the O-ring 3*c* provided in the nozzle holding means 3, thereby enabling changing of the spouting directions of the orifices of the mist nozzle 1 or the shower nozzle 4. Accordingly, when only one section of hair needs to be concentratedly washed, such as when performing a permanent wave or hair coloring, or when hair is partly dirty, or the like, the orifices of the mist nozzles 1 of the mist heads M1 to M6 or the shower nozzles 4 of the shower heads S1 to S12 are turned to parts where washing needs to be performed, thereby enabling concentrated washing of those parts. Thus, it is possible to efficiently perform hair washing. In addition, the directions of spout orifices 1*a* and 4*a* of the mist nozzles 1 of the mist heads M1 to M6 and the shower nozzles 4 of the shower heads S1 to S12 are fixed in accordance with a hair style such as long hair or short hair and a size of a head of a person under hair washing so that washing water can be spread over the whole hair, thereby preventing a situation such that some parts of the head cannot be washed. Thus, it is possible to perform washing over the whole head.

What is claimed is:

1. An automatic hair washer including a cistern into which a person under hair washing inserts his head, wherein said cistern includes a liquid spouting means for spouting liquid supplied from a supply pipe provided on an inner wall of said cistern, said liquid spouting means comprising:

a nozzle having a spouting orifice and a substantially spherical base part;

a coupler for connecting the nozzle to the supply pipe, said coupler comprising a cistern engaging portion and an end part, said end part comprising a nozzle receiving part having a hemispherical-shaped recessed part for engaging the substantially spherical base part;

nozzle holding means for fixing the nozzle and the coupler to inner walls of the cistern by putting the cistern between said cistern engaging portion of the coupler and the lower end of the nozzle holding means, said nozzle holding means comprising an engaging part for engaging with said end part of said coupler; and a touching part provided on the nozzle receiving part of the coupler for touching the base part, whereby said touching part slidably holds said base part along a face of the nozzle receiving part.

2. The hair washer claim 1, wherein said nozzle comprises and inlet orifice which communicates with said spouting orifice, said inlet orifice being adjacent a surface of said spherical base part of said nozzle and the nozzle receiving part of the coupler.

* * * * *